United States Patent [19]

Drake

[11] Patent Number: 4,467,532

[45] Date of Patent: Aug. 28, 1984

[54] APPARATUS AND PROCESS FOR DRYING LUMBER

[76] Inventor: Harry W. Drake, R.R. #1, Box 253, Marshall, Ill. 62441

[21] Appl. No.: 456,266

[22] Filed: Jan. 6, 1983

[51] Int. Cl.[3] ..... F26B 5/04; F26B 13/30

[52] U.S. Cl. ..... 34/16.5; 34/92

[58] Field of Search ..... 34/16.5, 92

[56] References Cited

U.S. PATENT DOCUMENTS

| | | | |
|---|---|---|---|
| 2,296,546 | 9/1942 | Toney | 34/15 |
| 2,830,382 | 4/1958 | Petersen | 34/45 |
| 3,018,561 | 1/1962 | Wells | 34/92 |
| 3,574,949 | 4/1971 | Farnsworth | 34/16.5 |
| 3,921,309 | 8/1974 | Nakayashiki | 34/13.8 |
| 4,058,906 | 11/1977 | Pagnozzi | 34/16.5 |
| 4,194,296 | 3/1980 | Pagnozzi et al. | 34/16.5 |

*Primary Examiner*—John J. Camby

*Attorney, Agent, or Firm*—Marmaduke A. Hobbs

[57] ABSTRACT

An apparatus and process for drying lumber under vacuum conditions using a drying vessel operationally connected to a sump which collects the extracted moisture. Vaccum conditions are maintained in the vessel and in the sump within the range of 10,000 to 15,000 microns, which reduces the boiling point of water to less than 80° F. The temperature within the vessel is raised to approximately 105° F. by a heating source and this combination of reduced pressure and elevated temperature causes the moisture in the lumber to boil off as vapor. This vapor is condensed inside the vessel by refrigeration coils cooled to a temperature between 36° F. and 42° F., and the liquid condensed on the coils is carried to the sump through a drain pipe where it is pumped to waste disposal through a flow meter. The process is capable of producing dried lumber with as little as 0% final moisture content, or the final moisture content can be predetermined by correlating empirical data on the density, amount, and moisture content of the lumber being dried from the amount of liquid passing through the flow meter.

20 Claims, 3 Drawing Figures

APPARATUS AND PROCESS FOR DRYING LUMBER

BACKGROUND OF THE INVENTION

Freshly cut lumber contains a substantial amount of moisture which must be removed before the lumber is suitable for commercial use as construction material, decorative material, or even as firewood. A number of factors affect the drying process, including the species of wood to be dried, the season of the year in which cutting takes place, the ambient temperature and humidity of the region in which drying is attempted, and the desired moisture content of the finished product, which varies with the species of wood and its planned application. In addition, the drying process must be carefully monitored and controlled to avoid causing problems such as warping, case hardening, shrinkage, checking, and cellulose destruction, any or all of which may occur in the lumber upon attempts to hasten the drying process under less than optimum conditions.

Many methods have heretofore been tried to effect the drying of lumber, ranging from open-air drying, a process which may take anywhere from two to four months up to a year or more depending on the species of wood, and useless when the relative humidity is above 60%; to kiln-drying where heated air is circulated around and through a stack of lumber, which process may take one to two months; to various methods in which drying is effected in a vacuum. U.S. Pat. No. 2,296,546 to Toney discloses a method in which steam is introduced into one chamber under vacuum conditions to remove some of the moisture content of the lumber, followed by kiln-drying the partially dehydrated lumber in a second chamber to reduce the moisture content of the lumber further. Thus, the stack of lumber must be transferred from one vessel to another during the drying process and the method is only able to achieve a final moisture content of 14–16% in the lumber, this figure being unacceptably high for many applications. In addition, the temperature of the steam introduced into the first chamber, 220° F., is high enough to risk cellulose damage in the lumber. Cold water is circulated through pipes within the first chamber to promote circulation and to assist in reducing the pressure.

U.S. Pat. No. 2,830,382 to Petersen, discloses a method wherein lumber to be dried is stacked in a chamber without providing space between the boards. The equipment used includes vacuum means in conjunction with a refrigeration unit, said unit preferably being mounted on the outside of the drying chamber with pipe coils extending into the chamber for maintaining the temperature inside the chamber at or slightly below 35° F. At this temperature and the low pressure provided by the vacuum, oils and other extractives tend to evaporate from the wood, leaving the water, which must then be removed by air-drying. The process must be halted at scheduled intervals to defrost the coils and remove accumulated ice and other congealed extractives. Warm air is provided for this defrosting stage to help defrost the coils and to prevent the lumber from freezing. Since air-drying is required, the moisture content becomes dependent on the length of air-drying time. A similar device is disclosed in U.S. Pat. No. 3,574,949 to Farnsworth, except that the refrigeration system is disposed inside the drying chamber to transform moisture extracted from the lumber into ice crystals and then by sublimation into water vapor, requiring a critical sublimation balance to be maintained. Heat is supplied to the drying chamber to help effect sublimation and to scavenge any air remaining in the chamber which is not removed by the vacuum pump.

Typically, existing vacuum drying devices have encountered difficulty in managing the large amount of moisture which is liberated during the drying process, and the processes must be halted in order to purge the systems of moisture, whereupon the cycles are repeated to effect further drying. If the drying process is not carefully monitored and controlled, the lumber may suffer from warping, case hardening or any number of the previously listed hazards, resulting in a lowering in the grade of the lumber, lost time and energy, and possible destruction of valuable materials. In addition, it has been found to be very difficult or even impossible to obtain a final moisture content below 5–6% in the lumber without damaging it, and where obtainable, as discussed in U.S. Pat. No. 3,921,309 to Nakayashiki, where the specification relates examples of dried lumber with moisture contents ranging from 0–10%, the hot air and vacuum steps must be repeated from 3 to 8 times and the entire sequence of steps must be repeated from 4 to 20 times, thus necessitating close monitoring of the process along with the increased costs of such monitoring.

The moisture content of green lumber is mainly water with small percentages of sap and other constituents present. The primary objective in the drying of lumber is to remove or reduce this water content in order to provide a suitable product. Thus, while it is well known that the boiling point of water is lowered by reducing the atmospheric pressure through vacuum means, and some prior art references in this area have used reduced pressure and elevated temperatures to boil the water out of the lumber, none of the processes have been able to accomplish complete drying in a single drying vessel without stopping the process to remove the accumulated vapor. In addition, prior devices have used temperatures high enough to cause cellulose destruction in the lumber, which may render the lumber useless for anything except firewood. The equipment which uses very low temperatures to transform the extracted moisture into ice must be halted during the drying process to remove the accumulated ice.

SUMMARY OF THE INVENTION

It is, therefore, one of the principal objects of this invention to provide an apparatus and process for drying lumber under vacuum conditions in which a vacuum is maintained throughout the drying process and the process is carried out at relatively low temperatures, thus minimizing the risk of cellulose damage in the lumber.

Another object of this invention is to provide an apparatus for drying lumber which consists of a single drying vessel with a collecting sump, thus eliminating any need to transfer the lumber during the drying operation, and into which lumber can be placed immediately upon cutting into boards so that the drying process can be started.

A further object of this invention is to provide an apparatus and method for drying lumber in which drying is effected under conditions of approximately 100% relative humidity, thus minimizing the risks of warping, checking, shrinkage, or case hardening, thereby providing dried lumber with acceptable physical characteristics, with overall costs being an average of only 20% of the costs of conventional systems.

A further object of this invention is to provide an apparatus for drying lumber in which precise control can be maintained to the extent of total automation, and in which atmospheric or seasonal variables, or variables in the lumber itself, have little influence on the overall process.

A further object of this invention is to provide a process for drying lumber which can reduce the moisture content of the lumber to 0% if necessary, and which can reduce the time required for drying to 10% of the time required by conventional systems.

A still further object of this invention is to provide a process for drying lumber which encounters no difficulties in managing the large amount of moisture liberated from the lumber using a single vessel, and which causes no physical damage to the lumber.

These and other objects are attained in the present invention, which relates to an apparatus and process for drying lumber having a single sealable drying vessel, of sufficient size to accommodate an economical quantity of green lumber, and sufficient strength to withstand high vacuum conditions, with a door designed to close against a gasket to prevent vacuum leakage. Vacuum conditions are maintained throughout the drying process within a range of 10,000–15,000 microns, which reduces the boiling point of water to less than 80° F., thus keeping the heating requirements at a minimum level. A hot water boiler with a water temperature maintained in the area of 150° F. is used as a heating source, with the ambient temperature within the vessel maintained around 105° F. In one embodiment, finned heating tubes are disposed inside and at the bottom of the vessel and designed to maintain the relatively low differential between the water temperature and the vessel temperature so as to minimize the chances of hot spots immediately above the heating tubes causing cellulose destruction in the lumber.

Under these conditions, the moisture in the lumber is emitted as steam to the extent that drying conditions are maintained at approximately 100% relative humidity. High humidity conditions minimize the possibility of damage to the lumber resulting from case hardening with resultant stress problems, honey combing, splitting, or excessive warpage. In this embodiment, finned, gravity-type refrigeration coils are disposed inside and at the top of the vessel to maintain control of the humidity. The coils are maintained at a temperature between 36° F. and 42° F., 39° F. being the point at which water reaches its greatest density, this temperature being best suited for maximum condensation of the moisture. The coils condense the steam into liquid, which is caught in an insulated trough, supplied with a drain pipe, for removing the collected liquid. Condensate shields preferably are provided on the inside periphery of the drying vessel to catch any condensation which may form on the inside walls and to deposit it at the bottom of the vessel where perforations in the drain pipe allow this residual condensate to drain into the pipe from the bottom of the vessel. In this apparatus, the drain pipe leads to a collecting sump, disposed so that the top level of the sump is below the level of the bottom of the drying vessel, and designed so as to maintain vacuum conditions in the drying vessel. A vacuum pump pulls the vacuum through the top of the sump, and since the liquid being drained into the sump enters below the existing liquid level, it is condensed and trapped in this existing liquid and substantially dry air is pulled through the vacuum pump, thus protecting the pump and the pump oil from moisture damage. A submersible sump pump is provided inside the sump and controlled by a pre-set float switch to evacuate the sump of condensate when needed through a check valve, thereby preserving the vacuum. A flow meter is normally provided downstream from the check valve to accurately measure the amount of condensate extracted from the lumber, thereby assisting in predicting the moisture content remaining in the lumber. Through correlation of the amount of condensate extracted, the amount and species of lumber used, and the corresponding drop in humidity within the vessel, an approximate determination can be made as to the status of the drying process at any time during the operation.

The lumber drying apparatus and process of the present invention normally has as optimum conditions in a control system, the following: a level of vacuum in the system controlled within a range of 10,000–15,000 microns by common vacuum control circuitry in conjunction with a vacuum pump; a temperature in the drying vessel maintained at approximately 105° F. by a thermostat which controls the circulation pump of the hot water heating system; and a relative humidity within the drying vessel regulated by the temperature of the refrigeration coils controlled by a humidity sensor inside the vessel and connected to a control which is wired in series with a control for the refrigeration unit. Thus, as the drying operation proceeds, the humidity sensor and control determine whether more or less cooling is required and activate the control for the refrigeration unit as needed. This prevents frost from forming on the refrigeration coils, keeps the vapor escape level of the wood at a point which prevents internal stress buildup and resultant case hardening, and maintains the temperature of the coils at the optimum level for maximum condensation of the moisture. Thus, there are several major improvements in the present invention. The moisture is extracted from the lumber as steam and condensed into liquid in the same vessel, at temperatures which facilitate the process without damaging the lumber. The process is continuous once begun and need not be halted to remove the extracted moisture. In addition, the process is capable of automation and the desired moisture content of the finished product can be preselected with reasonable certainty and the time required to reach this point can be easily determined.

DETAILED DESCRIPTION OF THE PREFERRED EMBODIMENT

Figure 1:
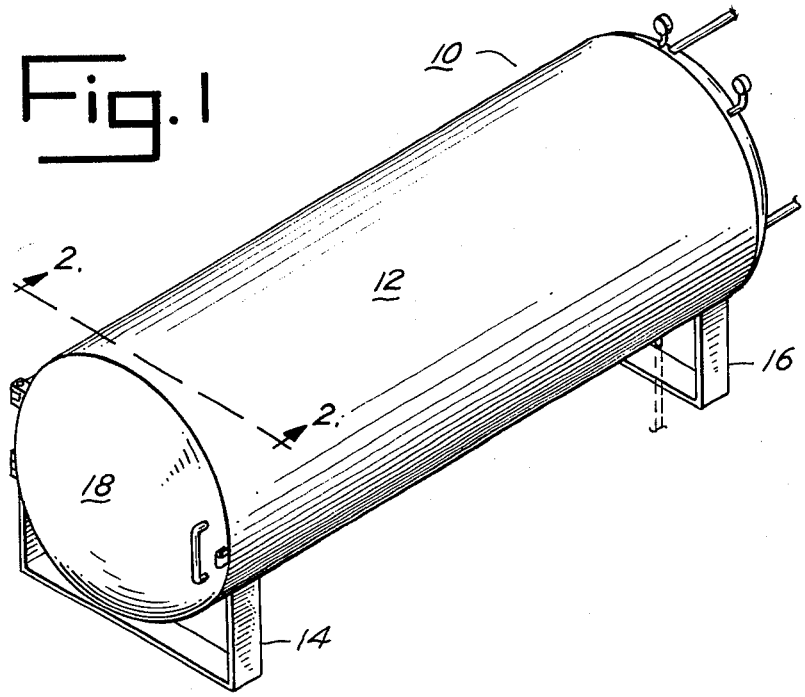
FIG. 1 is a perspective view of the lumber drying apparatus embodying the present invention.

Referring more specifically to the drawings, and to FIG. 1 in particular, numeral 10 indicates generally a lumber drying apparatus embodying the present invention, wherein numeral 12 indicates a metallic drying vessel of sufficient size to handle an economical quantity of green lumber and sufficient strength to withstand relatively high vacuum conditions. Freshly sawed lumber, which has been cut into any of a number of various board sizes is immediately placed in the vessel, stacked with air spaces therebetween. The air in the vessel and in the sump is evacuated via a vacuum pump, creating a vacuum atmosphere within the vessel and the sump, and the drying process is thereafter initiated. Vacuum, heat, and humidity within the drying vessel are monitored and controlled automatically to maintain optimum conditions and achieve rapid drying. The apparatus and process of the present invention are suitable for use with all types and varieties of lumber, the control system being adjustable to compensate for the different wood species which represent a wide spectrum of wood densities and moisture contents.

Figure 2:
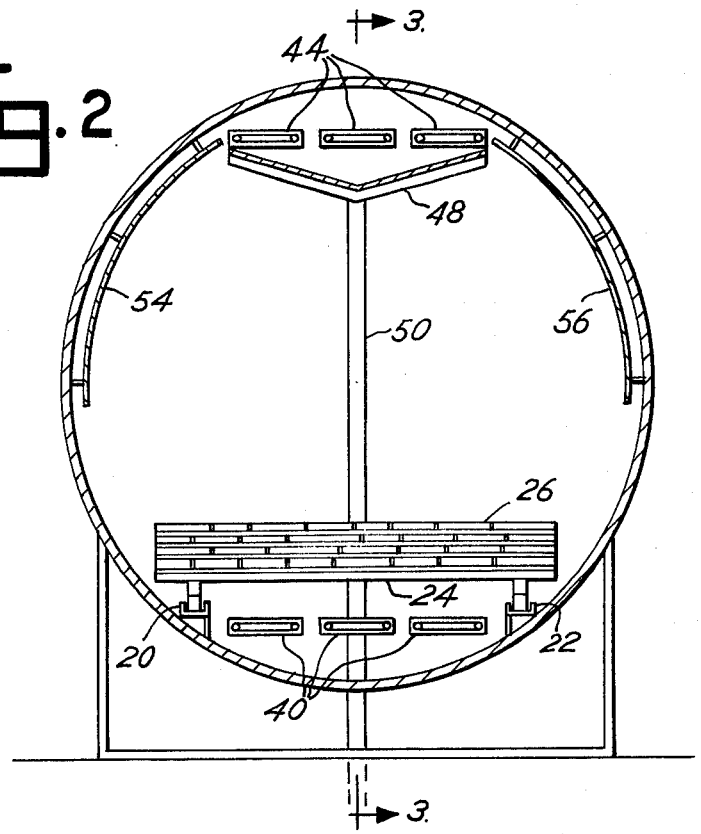
FIG. 2 is a vertical cross sectional view of the lumber drying apparatus shown in the preceding figure, the section being taken on line 2—2 of FIG. 1.
Figure 3:
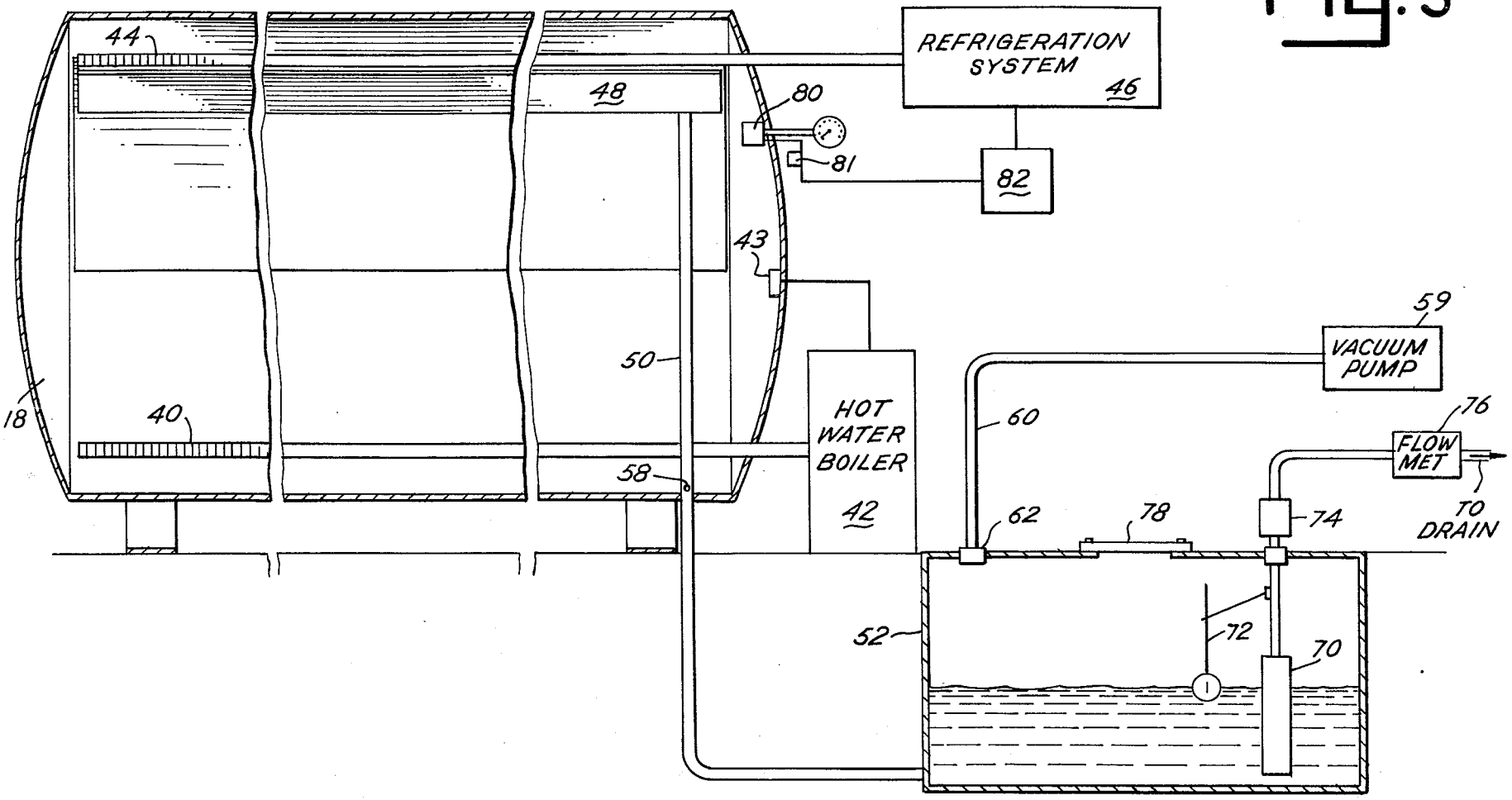
FIG. 3 is a diagrammatic longitudinal cross sectional view of the lumber drying apparatus shown in the preceding figures, the section being taken on line 3—3 of FIG. 2, including the control systems and the collecting sump.

The drying vessel is equipped with finned heating tubes operationally connected to a hot water boiler as a heat source for raising the temperature within the vessel, and finned refrigeration coils, operationally connected to a conventional refrigeration system, are used to condense the moisture which is emitted from the lumber as steam under vacuum conditions and elevated temperatures. A V-shaped insulated trough is disposed beneath the refrigeration coils to collect the condensed moisture and to drain it into a drain pipe which carries the moisture to the sump. Condensate shields are mounted inside the drying vessel on both right and left sides, as viewed in FIG. 2, to catch any condensation which may form on the inside walls of the vessel and to deposit this condensation at the bottom of the vessel where it drains into perforations provided in the drain pipe. These shields and the insulated trough protect the lumber from staining which would be caused by the condensed moisture dripping on the lumber.

The sump is equipped with a vacuum pump which pulls the air from the top of the sump, above the liquid level, and since the drain pipe enters below the liquid level, most of the moisture removed from the drying vessel is entrapped in the liquid in the sump and the vacuum pump then pulls relatively dry air from the top of the sump, thereby protecting the vacuum pump from moisture damage. A submersible sump pump is disposed inside the sump and controlled by a pre-set float switch to evacuate the sump when necessary. Evacuation proceeds through a check valve, thereby preserving the vacuum, and a flow meter, downstream from the check valve, tracks the progress of the drying process.

The vessel 12 shown in FIG. 1 has supporting legs 14 and 16 which provide clearance from ground level, and a sealable door 18 on one end which closes against a gasket to form an air tight enclosure suitable for maintaining vacuum conditions within the vessel. Supports 20 and 22 are provided inside the vessel for holding platform 24 which provides a level surface upon which the green lumber is stacked. A quantity of lumber 26 is shown stacked on this platform; however, this quantity is shown for illustration purposes only, as the vessel is designed to be substantially filled with lumber to be dried, the capacity of the example shown being approximately 8,000 to 10,000 boardfeet. Finned heating tubes 40 are located inside the vessel and below the lumber platform and operationally connected to a conventional hot water boiler 42, located outside the drying vessel, through welded pipe couplings for both output and return water lines. In normal operation of the apparatus, the boiler temperature is maintained at approximately 150° F., and the temperature within the vessel is maintained at approximately 105° F. This relatively low differential between the boiler temperature and the vessel temperature is maintained by a thermostatic means 43 to minimize the chances of hot spots immediately above the heating tubes, which can cause cellulose destruction in the lumber if the temperature exceeds 150° F., as it does in many current methods of drying lumber.

Finned, gravity type refrigeration coils 44 comprising a refrigeration condensing unit are disposed inside and near the top of the vessel for condensing moisture which is emitted as vapor from the drying lumber. These coils are preferably maintained at a temperature between 36° F. and 42° F., 39° F. being the temperature at which water reaches its greatest density, this temperature range being best suited for maximum condensation of the moisture. The refrigeration coils are operationally connected to a conventional refrigeration system 46, located outside the drying vessel, through welded pipe couplings for a liquid line, and a suction line with expansion valves outside the couplings, and control bulbs attached to the suction line at the entrance of the suction line into the vessel. The latent heat load calculated in a vacuum is roughly 1000 BTU's/pound of water. The finned heating tubes and refrigeration coils are engineered with this latent heat load considered, to absorb or dissipate heat using the minimum tubing footage required for optimum results. Thus, where the load is accurately balanced, the only remaining variable is the density of the lumber. The condensed moisture drips off the refrigeration coils and is collected in a V-shaped insulated trough 48, disposed immediately below the coils and extending the full length thereof, the insulation being used to prevent condensation from forming on the bottom of the trough where it could drip onto and stain the drying lumber. The trough is supplied with a drain pipe 50, located at the rear of the vessel, which carries the accumulated condensate to a sump 52. When the temperature outside the drying vessel is below the temperature inside the vessel, condensation will form on the inside walls of the vessel. To prevent this condensation from dripping on and possibly staining the lumber, condensate shields 54 and 56 are provided inside the vessel, extending from a point just above the upper edge of the insulated trough 48 to a point half way down the side of the vessel on both right and left sides, as viewed in FIG. 2, where the condensate is deposited on the lower side of the inside wall and flows to the bottom of the vessel, where it then drains into the drain pipe 50 through perforations 58 provided in the pipe at this level.

The drain pipe 50 leads to a collecting sump 52, disposed so that the top level of the sump is below the bottom level of the drying vessel, thus keeping the bottom of the vessel above the highest possible liquid level in the sump. The drain pipe enters the sump at the bottom of one side, below the liquid level, thereby preserving the vacuum and ensuring that all moisture entering the sump is trapped in the liquid already present in the sump. A vacuum pump 59 provides the vacuum required for the drying process and is connected to the sump through piping 60 connected by a coupling 62 in the top wall of the sump, the pump maintaining effective vacuum conditions within the sump and drying vessel. When the drying process is started, the vacuum pump evacuates the air from the sump and vessel, then, as extracted condensate begins to drain into the sump, the vacuum is maintained by pulling the air through the liquid and out of the top of the sump by the vacuum pump. By trapping the extracted condensate in the liquid present in the sump, the vacuum pump pumps mostly dry air, thus protecting the pump and the pump oil from moisture damage. The sump is emptied of liquid by a submersible sump pump 70, controlled by a pre-set float switch 72, which switches the sump pump on when the liquid in the sump reaches a certain predetermined level. The liquid evacuation takes place through a check valve 74 which allows only liquid outflow, thereby preserving the vacuum in the sump and vessel. The liquid is pumped through the check valve to a flow meter 76 which registers the amount of liquid flowing through the meter, thereby providing an indicator of the progress of the drying process and allowing accurate predictions to be made as to the time required to finish the process. The liquid passing through the flow meter is directed to a drain and is disposed of in a conventional manner. A sealable, removable plate 78 is provided in the top of the sump to allow access to the inside of the sump for any needed adjustments, repairs or cleaning.

A humidity sensor 80 mounted inside the drying vessel is wired to a control 81 which is wired in series with a control 82 for the refrigeration unit, permitting both internal control of the refrigeration system and precise control of the condensation of moisture in the drying vessel, thus controlling the relative humidity. Accurate and precise control of the humidity level within the drying vessel permits control of the vapor escape level of the lumber and keeps this vapor escape level low, thereby preventing case hardening, which occurs when attempts are made to accelerate the drying process. Since conditions in the compressor are correlated with the temperature of the refrigeration coils, when the temperature of the coils drops to a point where frost begins to form, the humidity drops as a result of condensing at too low a pressure. The control for the refrigeration unit maintains the coil temperature at the optimum level for maximum condensation of the moisture. The humidity level within the drying vessel is a controlled variable which is adjustable and controllable automatically through correlation of the amount, density, and moisture content of the lumber, values which can be determined from empirical data, with the settings of the control system, thereby maintaining optimum conditions for rapid drying.

In the use and operation of the lumber drying apparatus and process of the present invention, freshly sawed lumber, cut into any of a number of various board sizes, is placed inside the drying vessel 12 in a stacked configuration on the platform 24, leaving air spaces between the boards, and the door is closed and sealed. The air in the drying vessel and the sump 52 is then evacuated by the vacuum pump 59 creating vacuum conditions in the system within a range of 10,000 to 15,000 microns, which lowers the boiling point of water to less than 80° F. The hot water boiler 42 and the heating tubes 40 then combine to raise the temperature within the vessel to approximately 105° F., well below temperatures which can cause cellulose destruction in the lumber but above the lowered boiling point. At this temperature under vacuum pressure, moisture in the lumber is boiled and emitted as vapor. As the relative humidity level within the vessel reaches 100%, the humidity sensor 80 and control 81 activate the control 82 for the refrigeration system, which causes the refrigeration system 46 to begin cooling the refrigeration coils 44 to a temperature between 36° F. and 42° F. The coils at this point are considerably below the dew point of the saturated vapor and the vapor condenses upon contact with the coils and drips into the insulated trough 48. The natural gravitational tendencies and diffusion characteristics of steam, heat, and refrigeration under vacuum conditions are relied upon to produce the desired results in the drying vessel, and the relative positions of the heating tubes at the bottom of the vessel and the refrigeration coils at the top of the vessel are important to the satisfactory operation of the apparatus.

Condensation forming on the inside walls of the drying vessel is caught by the condensate shields 54 and 56 and directed to the bottom of the vessel where it enters the drain pipe 50 through perforations 58 in the drain pipe. This condensate and the condensate dripping off the refrigeration coils into the insulated trough flow through the drain pipe and enter the sump at the bottom end of the side wall. Since the highest possible liquid level in the sump is disposed below the bottom level of the drying vessel, the flow of liquid into the sump is effected mainly by gravity with some help provided by the pulling action of the vacuum pump. When the liquid in the sump reaches a certain level, a submersible sump pump 70, controlled by a pre-set float switch 72, is activated to evacuate the liquid contents of the sump through a check valve 74, which preserves the vacuum in the system. The condensate entering the sump is in liquid phase; however, due to the reduced pressure and elevated temperatures in the system, a slight increase in temperature or decrease in pressure can cause a return to the vapor phase. To prevent this, the drain pipe enters the sump at the bottom of the side wall where, after the process has begun, liquid will enter below the existing liquid level, thus ensuring that all of the moisture entering the sump will be condensed and remain in liquid phase. The vacuum pump thus pulls relatively dry air through the top of the sump, protecting the pump and the pump oil from moisture damage, and the float switch on the submersible sump pump activates the pump before the liquid fills the sump, providing further protection by keeping the liquid away from the vacuum pump inlet coupling.

The control system of the present invention is set to operate automatically throughout the drying process. The level of vacuum within the system is maintained within a range of 10,000 to 15,000 microns by common vacuum control circuitry in conjunction with a vacuum pump. The temperature inside the drying vessel is maintained at about 105° F. by thermostatic means 43 controlling the circulation pump in the hot water heating system. The relative humidity within the drying vessel is maintained at or near 100% by the humidity sensor and control and the control for the refrigeration unit which adjusts the temperature of the refrigeration coils, thereby controlling the rate of vapor condensation.

The condensate pumped out of the sump is measured through a flow meter 76, which allows predictions to be made as to the status of the drying process. By comparing empirical data on the density and moisture content of the species of wood being dried and the amount of condensate passing through the flow meter, determinations can be made at any time during the drying process of the moisture content remaining in the lumber and of the time required to finish the process, providing for dried lumber with a preselected final moisture content. When this point is reached, the system can be shut down and the dried lumber removed from the vessel.

Although one embodiment of a lumber drying apparatus and process has been described in detail herein, various changes and modifications may be made without departing from the scope of the invention.

I claim:

1. A lumber drying apparatus for drying lumber which has been cut into any of a number of various board sizes, comprising a structure defining a sealable vessel having an opening for receiving a quantity of green lumber to be dried, a sealable door mounted on said vessel for closing and sealing the opening in said vessel, a sump connected to the lower part of the vessel for collecting the moisture extracted from said lumber, means connected to said sump for creating and maintaining a vacuum in said sump and thereby creating and maintaining a vacuum in said vessel, heating means for raising the temperature in said vessel and maintaining the temperature at a desired level for facilitating emmission of vapor from the lumber, refrigeration means for condensing said emitted vapor to a liquid phase, means for collecting and directing said liquid to said sump thereby keeping said liquid away from said lumber, and pumping means for removing the collected liquid from said sump.

2. A lumber drying apparatus as defined in claim 1 in which said vessel comprises a cylindrically-shaped structure with an opening on one end thereof for receiving a quantity of lumber to be dried.

3. A lumber drying apparatus as defined in claim 2 in which said sump is disposed adjacent to said vessel so that the uppermost level of said sump is below the level of the bottom of said vessel, said sump is operationally connected to said vessel through a drain pipe, and said sump is sealable to maintain vacuum conditions within said sump.

4. A lumber drying apparatus as defined in claim 3 in which said means for creating and maintaining a vacuum consists of a vacuum pump operationally connected to the top of said sump for evacuating the air in said sump and in said vessel, reducing the pressure to a level within the range of 10,000 to 15,000 microns, whereby the boiling point of water within said vessel is reduced to less than 80° F.

5. A lumber drying apparatus as defined in claim 4 in which said heating means includes finned heating tubes disposed inside and near the bottom of said vessel and operationally connected to a hot water source disposed outside said vessel for raising the temperature inside said vessel to approximately 105° F., and a thermostatic means for controlling said raised temperature.

6. A lumber drying apparatus as defined in claim 5 in which the reduced pressure and elevated temperature within said vessel create conditions whereby the moisture within the lumber is boiled from the lumber as vapor.

7. A lumber drying apparatus as defined in claim 6 in which said refrigeration means includes finned refrigeration coils disposed inside and near the top of said vessel, and a refrigeration system disposed outside said vessel and operationally connected to said coils for condensing said emitted vapor to a liquid phase from a vapor phase.

8. A lumber drying apparatus as defined in claim 7 in which said means for directing said liquid to said sump includes an insulated trough disposed immediately below said refrigeration coils for catching said condensed liquid, a drain pipe at the rear of said vessel, extending from said trough to said sump for carrying said liquid to said sump, condensate shields disposed inside said vessel and extending from a point just above the upper edges of said insulated trough to a point approximately half way down the side of said vessel on opposite sides for depositing at the bottom of said vessel any condensation forming on the inside walls of said vessel, said condensation flowing into said drain pipe through perforations in said drain pipe for carrying to said sump.

9. A lumber drying apparatus as defined in claim 8 in which said pumping means includes a submersible sump pump disposed inside said sump, and a pre-set float switch automatically controls said pump for pumping the collected liquid out of said sump.

10. A lumber drying apparatus as defined in claim 9 in which said apparatus has control means including a humidity sensor disposed inside said vessel and a control for said refrigeration means, said control means determining the amount of humidity present within said vessel and adjusting the rate of condensation to keep the relative humidity level within the vessel at or around 100% as the drying operation proceeds.

11. A lumber drying apparatus as defined in claim 10 in which a platform is disposed within said vessel for green lumber in a stacked configuration with air spaces therebetween for allowing circulation of the atmosphere within said vessel between and through said stacked lumber.

12. A process for drying lumber which has been cut into any of a number of various board sizes, using an apparatus having a sealable drying vessel with a sealable door mounted thereon, heating means and refrigeration coils disposed inside said vessel, said vessel being operationally connected to a sealable collecting sump through a drain pipe for collecting the moisture extracted from the lumber, comprising the steps of:

(a) placing green lumber to be dried into said vessel in a stacked configuration with air spaces therebetween to allow the atmosphere within the vessel to circulate through the stacked lumber;

(b) closing and sealing the door of said vessel;

(c) evacuating the air in said vessel and in said sump for creating a vacuum atmosphere within said vessel and said sump within a range of 10,000 to 15,000 microns to lower the boiling point of water to less than 80° F.;

(d) raising the temperature within said vessel for driving off the moisture within the lumber as vapor under the reduced pressure and elevated temperature conditions;

(e) cooling the refrigeration coils to a temperature between 36° F. and 42° F. for condensing the vapor emitted from the lumber to liquid form; and (f) collecting the condensed vapor in the sump.

13. The process of claim 12 in which the temperature is raised to approximately 105° F.

14. The process of claim 12 in which vacuum conditions are maintained in said vessel and in said sump throughout the drying process.

15. The process of claim 14 wherein the temperature within the vessel is maintained at approximately 105° F.

16. The process of claim 15 in which the reduced pressure substantially lowers the boiling point, temperature of water, and the ambient temperature within said vessel is raised to a point above said lowered boiling point whereby the moisture present in the lumber is boiled from the lumber in vapor phase.

17. The process of claim 16 in which the moisture within the lumber is boiled under reduced pressure and elevated temperature and condensed from a vapor phase to a liquid phase in said drying vessel.

18. The process of claim 17 comprising the further step of maintaining high humidity conditions at or around 100% relative humidity within said vessel by adjusting the temperature of said refrigeration coils, thereby controlling the rate of condensation.

19. The process of claim 18 comprising the further step of pumping the condensed vapor out of said sump when the liquid contents reach a predetermined level.

20. The process of claim 19 comprising the further step of measuring the flow of liquid pumped out of said sump by pumping the liquid through a flow meter.

* * * * *